US012680722B2

(12) United States Patent
Bertsche et al.

(10) Patent No.: US 12,680,722 B2
(45) Date of Patent: Jul. 14, 2026

(54) METHOD FOR OPERATING A REFRIGERANT CIRCUIT

(71) Applicant: MAHLE INTERNATIONAL GMBH, Stuttgart (DE)

(72) Inventors: Dirk Bertsche, Rheinstetten (DE); Amadeus Trübsbach, Stuttgart (DE); Sascha Lindauer, Schorndorf (DE)

(73) Assignee: MAHLE International GmbH, Stuttgart (DE)

( * ) Notice: Subject to any disclaimer, the term of this patent is extended or adjusted under 35 U.S.C. 154(b) by 143 days.

(21) Appl. No.: 18/657,956

(22) Filed: May 8, 2024

(65) Prior Publication Data

US 2024/0377094 A1 Nov. 14, 2024

(30) Foreign Application Priority Data

May 9, 2023 (DE) ..... 102023204250.9

(51) Int. Cl.
*F24F 11/84* (2018.01)

(52) U.S. Cl.
CPC ..... *F24F 11/84* (2018.01)

(58) Field of Classification Search
CPC .. F24F 11/84; F24F 11/64; F24F 11/65; F24F 5/001; F25B 41/40; F25B 30/02; F25B 49/02
See application file for complete search history.

(56) References Cited

U.S. PATENT DOCUMENTS

| | | | | |
|---|---|---|---|---|
| 9,656,535 | B2 | 5/2017 | Heyl et al. | |
| 2014/0075966 | A1* | 3/2014 | Schmitz | B60H 1/00921 165/42 |
| 2021/0364204 | A1 | 11/2021 | Boger et al. | |
| 2023/0137140 | A1* | 5/2023 | Yamashita | B60H 1/0073 62/244 |

FOREIGN PATENT DOCUMENTS

| | | | | |
|---|---|---|---|---|
| DE | 102011015151 | A1 * | 5/2012 | F25B 41/00 |
| DE | 102013110224 | | 3/2014 | |
| DE | 102019131879 | | 5/2021 | |
| DE | 102021204470 | | 11/2021 | |
| DE | 112021000505 | | 11/2022 | |
| JP | 2016064704 | A * | 4/2016 | B60H 1/3208 |

OTHER PUBLICATIONS

English Translation of Search Report issued in DE 102023204250.9 (Dec. 12, 2023).

* cited by examiner

*Primary Examiner* — Emmanuel E Duke
(74) *Attorney, Agent, or Firm* — Barnes & Thornburg

(57) ABSTRACT

The present disclosure relates to a method for operating a refrigerant circuit through which a refrigerant circulates, in which heat is transferred from a first heat source to the refrigerant in a first heat pump mode, and from a second heat source to the refrigerant in a second heat pump mode. Efficiency and heating capacity are increased therewith in that heat is transferred to the refrigerant simultaneously from both the first heat source and the second heat source in a combined heat pump mode. The disclosure also relates to an air conditioning system that contains a refrigerant circuit operated in this manner.

17 Claims, 3 Drawing Sheets

METHOD FOR OPERATING A REFRIGERANT CIRCUIT

CROSS-REFERENCE TO RELATED APPLICATIONS

This application claims priority from German Patent Application No. DE 10 2023 204 250.9, filed May 9, 2023, the entirety of which is hereby fully incorporated by reference.

The present invention relates to a method for operating a refrigerant circuit, in particular for an air conditioning system, through which a refrigerant circulates. The invention also relates to an air conditioning system containing a refrigerant circuit operated in this manner.

A refrigerant that can emit or absorb heat circulates through a refrigerant circuit. The emission or absorption of heat normally takes place in heat exchangers through which the refrigerant flows. This type of refrigerant circuit can be used in an air conditioning system with which air from the air conditioning is supplied to an interior. It is desirable to increase the efficiency of these refrigerant circuits. When used in a vehicle, this increase in efficiency normally has a direct impact on the overall efficiency of the vehicle. In particular, the increase in efficiency can increase the travel range of vehicles that are at least partially electrically operated.

Constellations in which heat is absorbed in the refrigerant and used for heating purposes play a roll in increasing efficiency. By way of example, the heat in an air conditioning system can be used to heat the conditioned air from the air conditioning system. When used for heating purposes, the refrigerant obtains heat from at least one heat source.

A method for operating a refrigerant circuit in an air conditioning system is disclosed in DE 10 2013 110 224 B4. Both a first heat source and a separate second heat source are used in the method. The method implements a first heat pump mode and a second heat pump mode, in which heat is transferred to the refrigerant from the first heat source in the first heat pump mode and from the second heat source in the second heat mode when the air conditioning system is at the hottest setting.

The object of the present invention is to create an improved, or alternative, method for operating a refrigerant circuit of the above type for an air conditioning system.

This problem is solved according to the invention by the subject matter of the independent claims. Advantageous embodiments are the subject matter of the dependent claims.

The present invention is based on the idea of using two potentially available heat sources in a refrigerant circuit both separately and collectively to transfer heat to a refrigerant circulating through the refrigerant circuit. The efficiency, or the maximum heating capacity, can be improved through the parallel use of different heat sources. Moreover, the transfer of heat to the refrigerant from the heat sources can also be adapted to the actual circumstances, in particular to the amount of heat available in the heat sources, and/or to the amount of heat needed in the refrigerant circuit. This results in a more efficient refrigerant circuit.

This is the basis of a method for operating the refrigerant circuit. The refrigerant circuit can be operated in three heat pump modes for transferring heat from two heat sources to the refrigerant. The refrigerant circuit can be operated in these three heat pump modes to use two available heat sources such that the desired amount of heat can be obtained using the "heat pumps." In a first heat pump mode, heat is transferred from the first heat source to the refrigerant. In a second heat pump mode, heat is transferred from the second heat source to the refrigerant. In a third heat pump mode, heat is transferred to the refrigerant from both the first and second heat sources. This mode is also referred to below as the combined heat pump mode.

In the first heat pump mode, no heat is transferred to the refrigerant from the second heat source, and no heat is transferred to the refrigerant from the first heat source in the second heat pump mode. In the combined heat pump mode, heat is transferred to the refrigerant from both the first heat source and the second heat source.

Available heat sources, e.g. air or coolant, that have dropped to a low temperature, can be "pumped" to a higher temperature and made available for heating purposes at the desired temperature.

The refrigerant circuit is advantageously used in an air conditioning system. In particular, the refrigerant circuit can form the air conditioning system or be a part thereof. The temperature in an interior is controlled by the air conditioning system, i.e. heated and/or cooled and/or dehumidified and/or humidified. The air conditioning system can convey air conditioned accordingly into the interior. This air is referred to as conditioned air. The refrigerant circuit transfers heat to the refrigerant from the heat sources in the corresponding heat pump modes in order to heat the interior.

It is understood that the refrigerant can also be used for cooling purposes in the appropriate modes.

The refrigerant circuit contains a conveyor for pressurizing the refrigerant and thus conveying it through the refrigerant circuit. This conveyor uses energy, which also has an impact on the efficiency of the refrigerant circuit. When used in a vehicle, there is a reduced overall energy consumption. This reduced energy consumption advantageously increases the travel range of a vehicle that is operated at least partially electrically.

Another advantage is that through the parallel use of multiple heat sources, or the intentional use of a specific heat source, it is possible to increase efficiency as well as obtain the desired heating capacity.

The transfer of heat from the respective heat sources to the refrigerant takes place in a dedicated heat exchanger. This means that the refrigerant circuit preferably has a first heat exchanger dedicated to the first heat source and a second heat exchanger dedicated to the second heat source, through which the refrigerant can flow to absorb heat from the respective heat sources.

The absorption of heat from the respective heat sources, as well as the absence of this absorption is preferably achieved by setting or adjusting the flow of the refrigerant through the respective dedicated heat exchangers. If heat is to be transferred to the refrigerant from the first heat source, the refrigerant is conducted through the first heat exchanger. If no heat is to be transferred from the first heat source to the refrigerant, this flow through the first heat exchanger is interrupted. The second heat source and second heat exchanger also work in the same way.

The first heat source and second heat source can be of any type, as long as they are different from one another. This also means that they may be able reach different temperatures. By way of example, the first heat source can be ambient air, and the second heat source can be air from a heated interior.

The first and second heat sources are also preferably different.

The first heat source can be ambient air from the refrigerant circuit, in particular the air conditioning system.

The second heat source can be a fluid that can absorb heat. The second heat source is preferably a coolant that circulates through a separate circuit from that for the refrigerant, also referred to as the coolant circuit below. An element that generates heat is advantageously integrated in the coolant circuit, which transfers heat to the coolant. In a vehicle, this is the drive assembly. This means that at least one drive assembly transfers heat to the coolant, thus forming the second heat source. The drive assembly can be a traction motor or battery, or it can be some other component that discharges heat, e.g. a driver assistance system, computer, etc.

The air conditioning system can therefore contain both the refrigerant circuit and the coolant circuit. The air conditioning system preferably has a first heat exchanger through which the refrigerant and ambient air both flow separately. The air conditioning system also contains a second heat exchanger through which the refrigerant and the coolant flow both flow separately. The refrigerant and conditioned air both flow separately through a third heat exchanger. The conveyor pressurizes the refrigerant, thus conveying it through the refrigerant circuit. The air conditioning system also preferably contains a valve assembly with which the different heat pump modes can be implemented. The valve assembly can be set to three different settings. The refrigerant flows through the first heat exchanger and third heat exchanger, and is prevented from flowing through the second heat exchanger, in the first setting. The refrigerant circuit is operated in the first heat pump mode in the first setting, thus heating the conditioned air. The refrigerant flows through the second heat exchanger and third heat exchanger, and is prevented from flowing through the first heat exchanger in the second setting. In this setting, the refrigerant circuit is operated in the second heat pump mode, in which the conditioned air is also heated. The refrigerant flows through the first heat exchanger, the second heat exchanger, and the third heat exchanger in the third setting. In this setting, the refrigerant circuit is operated in the combined heat pump mode, in which the conditioned air is also heated.

The valve assembly can contain a selector valve, or be designed as such.

The valve assembly can also contain an upstream choke valve for at least one of the heat exchangers.

The refrigerant circuit, in particular the air conditioning system, can contain a control unit for operating the air conditioning system, or refrigerant circuit, in particular for switching between the different heat pump modes. The control unit is connected to the valve assembly.

In preferred embodiments, the temperature of the first heat source, i.e. the ambient air, is used to select the appropriate heat pump mode when the refrigerant circuit, in particular the air conditioning system, is used for heating purposes, which is referred to below as the first heating mode.

In the first heating mode, the refrigerant circuit is preferably operated in the first heat pump mode, if the temperature of the first heat source is higher than or equal to a limit value, also referred to below as the first heat source upper temperature. If the temperature of the first heat source is lower than a second limit value, which is lower than the first heat source upper temperature and is also referred to below as the first heat source lower temperature, the refrigerant circuit is operated in the second heat pump mode. The refrigerant circuit is thus operated in the second heat pump mode if the temperature of the first heat source is lower than the first heat source lower temperature, which is lower than the first heat source upper temperature. If the temperature of the first heat source is between the first heat source upper temperature and the first heat source lower temperature, the refrigerant circuit is operated in the combined heat pump mode.

The first heat source upper temperature is preferably a temperature, above which it is possible to sufficiently transfer heat from the first heat source to the refrigerant.

The first heat source lower temperature is preferably a temperature, below which it is not possible to transfer any significant heat from the first heat source to the refrigerant.

The first heat source upper temperature, in particular when the first heat source is ambient air, is preferably between −1° C. and +1° C., preferably 0° C. The first heat source upper temperature is therefore between 272 K and 274 K. The first heat source upper temperature is preferably 273 K.

The first heat source lower temperature, in particular when the first heat source is ambient air, is preferably between −15° C. and −5° C., preferably −10° C. The first heat source lower temperature is therefore between 258 K and 268 K. The first heat source lower temperature is preferably 263 K.

In another heating mode, also referred to below as the second heating mode, the difference in the temperatures of the two heat sources is used to select the heat pump mode. This means that the difference in the temperatures of the two heat sources is used to select the right heat pump mode.

In the second heating mode, the refrigerant circuit is preferably operated in the first heat pump mode if the difference between the temperature of the first heat source and second heat source is greater than a limit value referred to below as the upper temperature difference. The refrigerant circuit is operated in the second heat pump mode in the second heating mode if the difference between the temperature of the first heat source and second heat source is smaller than a threshold value, which is smaller than the upper temperature difference, also referred to below as the lower temperature difference. This means that the refrigerant circuit is operated in the second heat pump mode if the difference between the temperature of the first heat source and second heat source is smaller than the lower temperature difference, which is smaller than the upper temperature difference. If the difference between the temperature of the first heat source and second heat source lies between the lower temperature difference and the upper temperature difference, the refrigerant circuit is operated in the combined heat pump mode.

The respective temperature difference is advantageously selected such that more heat can be transferred more efficiently from the dedicated heat source to the refrigerant.

The lower temperature difference is advantageously between 2 K and 10 K lower than the upper temperature difference, in particular if the first heat source is ambient air and the second heat source is coolant. The lower temperature difference is preferably between 4 K and 6 K lower than the upper temperature difference.

The upper temperature difference is preferably between −0.5 K and 1.5 K, ideally 0 K. In other words, the first heat pump mode, and thus the first heat source, are used if the first heat source is not more than 0.5 K colder than the second heat source, i.e. when the upper temperature difference is at least −0.5 K. The first heat pump mode, and therefore the first heat source, can be used if the first heat source is at least 1.5 K warmer than the second heat source. The first heat pump mode can also be used whenever the minimum difference is between −0.5 K and 1.5 K. This minimum difference is advantageously 0 K. This means that the first heat pump mode, and therefore the first heat source, can be used if the temperature of the first heat source is at least equal to that of the second heat source.

In theory, it is possible to always operate the refrigerant circuit in the combined heat pump mode. This means that it is possible maintain a constant flow of the refrigerant through the first heat exchanger and the second heat exchanger in the heat pump mode.

In the combined heat pump mode, the absorbed heat is preferably adjusted to temperature of the respective heat sources. This means that a greater portion of the heat is transferred to the refrigerant from the second heat source than from the first heat source when the temperature of the first heat source decreases, and a lower portion is transferred from the second heat source when the temperature of the first heat source increases.

This increase is obtained by increasing the flow of the refrigerant through the relevant heat exchanger. This means that the increase in the portion of heat transferred from the second heat source to the refrigerant in relation to the heat transferred from the first heat source to the refrigerant takes place when the temperature of the first heat source decreases by increasing the flow of the refrigerant through the second heat exchanger, or decreasing the flow through the first heat exchanger. This is the same when the temperature of the first heat source increases. This means that when the temperature of the first heat source increases, the flow of the refrigerant through the first heat exchanger is increased, or reduced through the second heat exchanger.

The change in the portion, in particular the change in the flow through the heat exchangers, can take place in a number of ways. In particular, it can take place in stages. This simplifies implementation.

In order to select the heat pump mode, which is dependent on the heat present in the respective heat sources, the temperatures of the first heat source and second heat source are determined.

These temperatures can be measured directly in the heat sources.

It is also conceivable to determine these temperatures indirectly, through other variables. By way of example, it is possible to determine the capacity of the heat sources, the current capacity, the maximum available capacity, etc. It is also possible to determine the mass flow rate of the heat source, i.e. the ambient air and/or refrigerant, e.g. the air mass flow, the flow rate of the air, the coolant flow rate, etc.

It is understood that in addition to the method for operating the refrigerant circuit, or air conditioning system, the air conditioning system itself belongs to the scope of this invention.

It is also understood that three or more heat sources can also be used in the refrigerant circuit, in particular in the air conditioning system. In this case, each heat source has a dedicated heat exchanger.

Other important features and advantages of the invention can be derived from the dependent claims, the drawings, and the associated descriptions thereof.

It is understood that the features specified above and described below can be used not only in the given combinations, but also in other combinations or in and of themselves, without abandoning the scope of the present invention.

Preferred exemplary embodiments of the invention are shown in the drawings and shall be explained in greater detail below, in which the same reference symbols are used for the same or similar, or functionally similar, components.

Therein, schematically:

Figure 1:
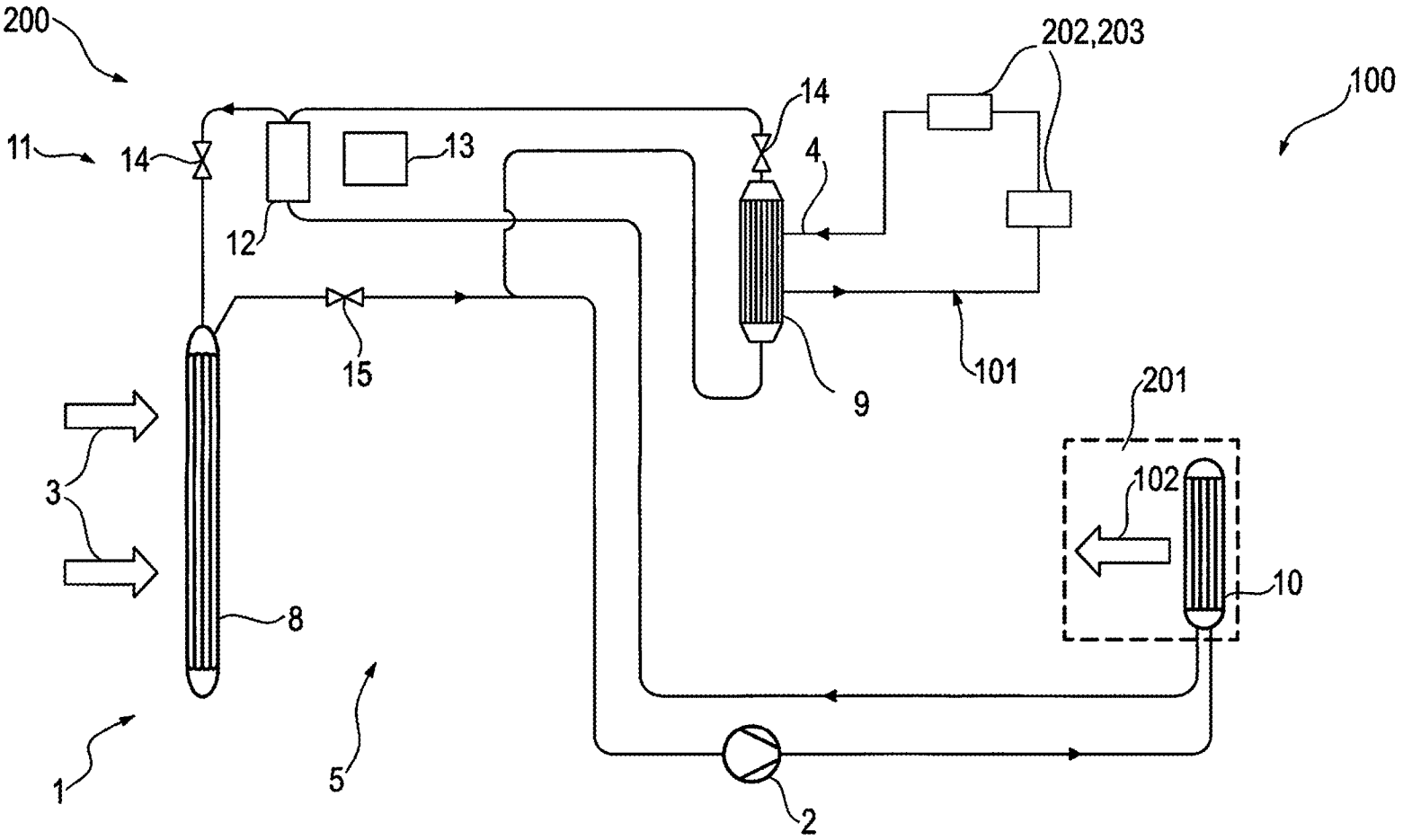
FIG. 1 shows a highly simplified circuit diagram of a refrigerant circuit in an air conditioning system, in a first mode.
Figure 2:
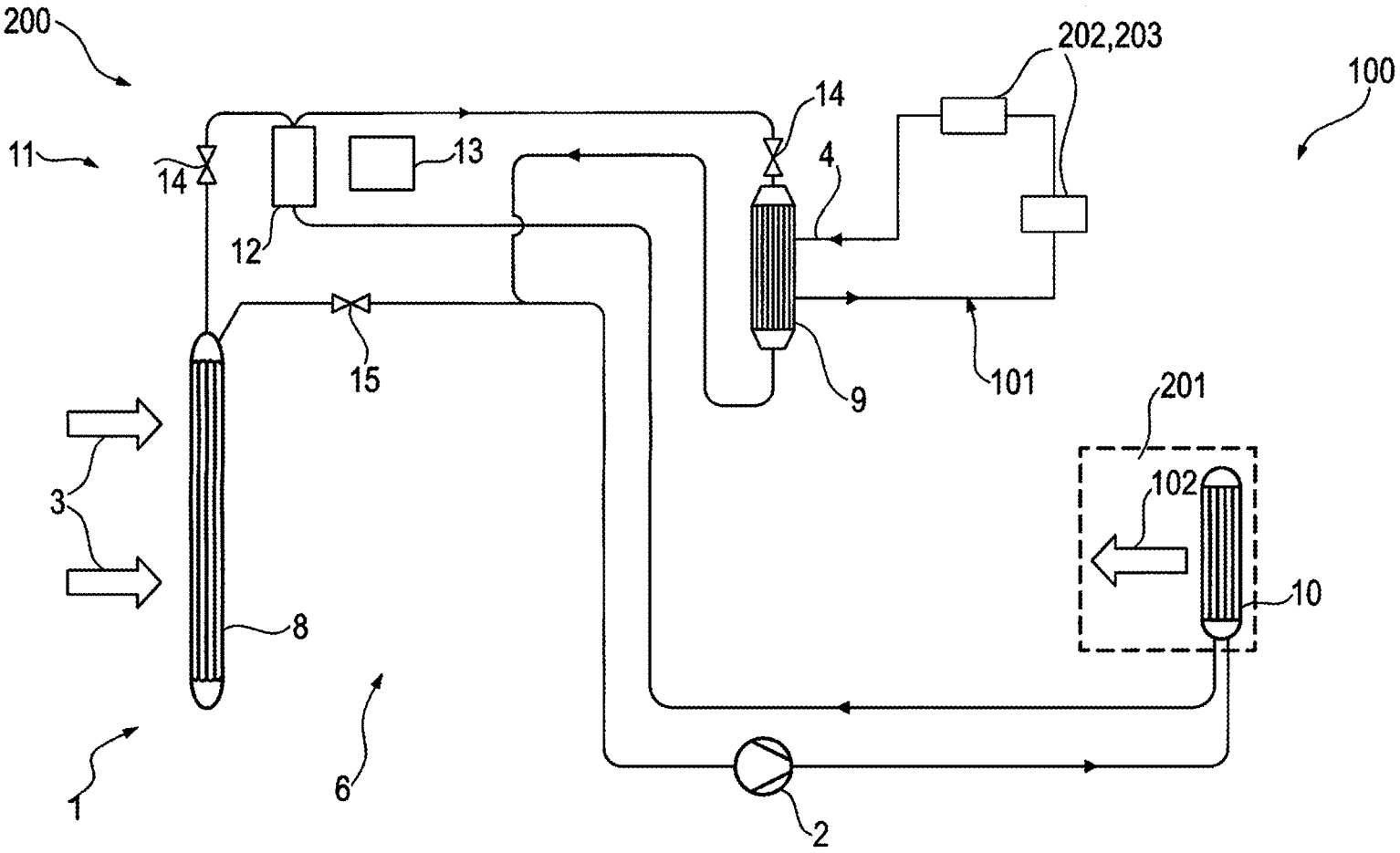
FIG. 2 shows the diagram shown in FIG. 1, with the refrigerant circuit in a second mode.
Figure 3:
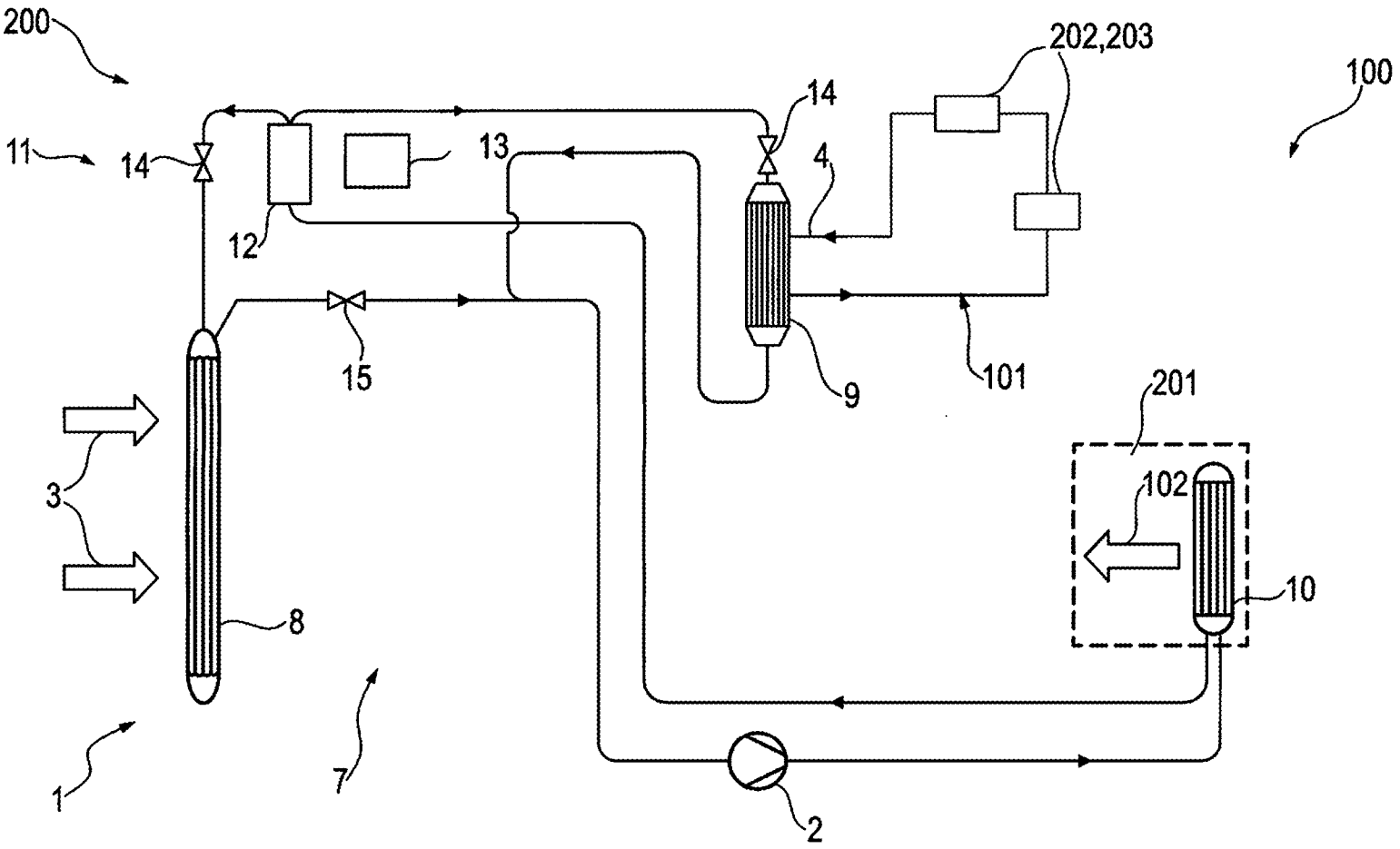
FIG. 3 shows the diagram shown in FIG. 1, with the refrigerant circuit in a third mode.

A refrigerant circuit 1 such as that shown in FIGS. 1 to 3 can be part of an air conditioning system 100. Air 102 is conditioned with the air conditioning system 100 in order to control the temperature in an interior 201, e.g. the interior of a vehicle 200. The air 102 conditioned by the air conditioning system 100 is referred to as conditioned air 102, and indicated by an arrow in the drawings.

A refrigerant circulates through the refrigerant circuit 1. The refrigerant circuit 1 has a conveyor 2 for this in the exemplary embodiment shown here, which pressurizes the refrigerant, thus conveying it through the refrigerant circuit 1. Heat can be transferred from two heat sources 3, 4 to the refrigerant in the refrigerant circuit 1. The first heat source 3 is ambient air in this exemplary embodiment, and the second heat source 4 is a coolant. The ambient air forming the first heat source 3 is indicated by arrows in the drawings. The refrigerant flows through a separate refrigerant circuit 1 from the coolant circuit 101 in the air conditioning system 100, and is also indicated by arrows. The heat in the coolant comes from at least one element 202 in the vehicle 200 integrated in the coolant circuit 101, which generates heat when in operation, that is transferred to the coolant. There are two of these elements 202 integrated in the coolant circuit 101 in this exemplary embodiment, which form drive elements 203 for the vehicle 200, e.g. a traction motor and/or battery (not shown).

To transfer heat from the heat sources 3, 4 to the refrigerant, and to transfer heat from the refrigerant to the conditioned air, the refrigerant circuit 1 can be operated in three different heat pump modes 5, 6, 7. In a first heat pump mode 5, shown in FIG. 1, heat from the first heat source 3 is transferred to the refrigerant. In a second heat pump mode 6, shown in FIG. 2, heat from the second heat source 4 is transferred to the refrigerant. In a combined heat pump mode 7, shown in FIG. 3, heat is transferred from the first heat source 3 and the second heat source 4 to the refrigerant.

The heat transferred to the refrigerant is used in the exemplary embodiment to heat the interior 201 with the conditioned air 102.

The refrigerant circuit 1 can be operated in the first heat pump mode 5 in a first heating mode, if the temperature of the first heat source 3, the ambient air, is higher or equal to a first heat source upper temperature. The first heat source upper temperature is between −1° C. and 1° C., preferably 0° C. in the exemplary embodiment. In the first heating mode, the refrigerant circuit 1 is operated in the second heat pump mode 6 if the temperature of the first heat source 3 is lower than a first heat source lower temperature. The first heat source lower temperature is between −15° C. and −5° C., preferably −10° C. in the exemplary embodiment, and is therefore lower than the first heat source upper temperature. The refrigerant circuit 1 is operated in the combined heat pump mode 7 in the first heating mode if the temperature of the first heat source 3 is between the first heat source upper temperature and the first heat source lower temperature.

The refrigerant circuit 1 is operated in the first heat pump mode 5 in a second heating mode if the difference between the temperature of the first heat source 3 and the second heat source 4 is greater than an upper temperature difference. If the temperature of the first heat source 3, i.e. the ambient air in the exemplary embodiment, is higher than the temperature of the second heat source 4, i.e. the coolant in the exemplary embodiment, by at least the temperature difference, the refrigerant circuit 1 is operated in the first heat pump mode 5. The refrigerant circuit 1 is operated in the second heat pump mode 6 in the second heating mode if the difference between the temperature of the first heat source 3 and second heat source 4 is lower than a lower temperature difference, which is lower than the upper temperature difference. The refrigerant circuit 1 is operated in the combined heat pump mode 7 in the second heating mode if the difference between the temperature of the first heat source 3 and second heat source 4 is between the lower temperature difference and upper temperature difference. In the exemplary embodiment, the lower temperature difference is between 2 K and 10 K, e.g. between 4 K and 6 K. The upper temperature difference is advantageously between −0.5 K and 1.5 K, preferably 0 K. The lower temperature difference is lower than the upper temperature difference.

To transfer heat from the respective heat sources 3, 4 to the refrigerant, the refrigerant circuit 1 in the exemplary embodiment contains dedicated heat exchangers 8, 9. This means that the first heat source 3 has a first dedicated heat exchanger 8, and the second heat source 4 has a second dedicated heat exchanger 9. The refrigerant and the ambient air flow separately through the first heat exchanger 8. The refrigerant and coolant flow separately through the second heat exchanger 9. The respective heat pump modes 5, 6, 7 are implemented in this exemplary embodiment by altering the flow of the refrigerant through the heat exchangers 8, 9. In the first heat pump mode 5, the refrigerant flows through the first heat exchanger 8, and is prevented from flowing through the second heat exchanger 9, as indicated by arrows in FIG. 1. In the second heat pump mode 6, the refrigerant flows through the second heat exchanger 9, and is prevented from flowing through the first heat exchanger 8, as indicated by arrows in FIG. 2. In the combined heat pump mode 7, the refrigerant flows through both the first heat exchanger 8 and the second heat exchanger 9, as indicated by arrows in FIG. 3. The refrigerant also flows through a third heat exchanger 10 in the different heat pump modes 5, 6, 7, through which the conditioned air 102 also flows separately and is heated. The conditioned air can therefore be regarded as a heat sink.

Switching between the different pump modes 5, 6, 7 is obtained with a valve assembly 11. As shown in the drawings, the refrigerant flows in this exemplary embodiment from the conveyor 2 to the third heat exchanger 10 and then to the valve assembly 11, which allows or prevents flow of the refrigerant to the first heat exchanger 8 and second heat exchanger 9, depending on the heat pump mode 5, 6, 7. The valve assembly 11 can thus be set to three settings, in which refrigerant flows through the first heat exchanger 8 and third heat exchanger 10, but not the second heat exchanger 9, in the setting for the first heat pump mode 5, as shown in FIG. 1. In the setting for the second heat pump mode 6, the valve assembly 11 allows the refrigerant to flow through the second heat exchanger 9 and the third heat exchanger 10, but not through the first heat exchanger 8, as indicated in FIG. 2. In the setting for the combined heat pump mode 7, the valve assembly 11 allows the refrigerant to flow through the first heat exchanger 8, second heat exchanger 9, and third heat exchanger 10, as indicated in FIG. 3.

The flow of the refrigerant through the first heat exchanger 8 and second heat exchanger 9 in the combined heat pump mode 7 is preferably adjusted to the available heat in the heat sources 3, 4 to which they are dedicated. In this case, the flow of refrigerant in the warmer of the heat sources 3, 4 is increased. In other words, in the combined heat pump mode 7, the portion of the heat transferred to the refrigerant from the second heat source 4 increases when temperature of the first heat source 3 decreases, and vice versa. This is obtained by altering the flow of the refrigerant through the first heat exchanger 8 and second heat exchanger 9, e.g. in stages. This change in the flow through the heat exchangers 8, 9 can also be obtained with the valve assembly 11.

The adjustment of the valve assembly 11 between different settings, as well as within the combined heat pump mode 7, can be obtained with a control unit 13 connected to the valve assembly 11.

As can be seen in the figures, the valve assembly 11 can be switched between different heat pump modes 5, 6, 7 by means of a selector valve 12. The valve assembly 11 can also contain a choke valve 14 dedicated to the first heat exchanger 8 and downstream thereof, and a choke valve dedicated to the second heat exchanger 9 and downstream thereof, for switching between the different heat pump modes 5, 6, 7.

There can also be another valve 15 between the first heat exchanger 8 and the compressor 2, as shown in the drawings, which is stationary, and causes a change in pressure in the refrigerant and/or blocks the flow of refrigerant from the second heat exchanger 9 to the first heat exchanger 8.

This specification can be readily understood with reference to the following Numbered Paragraphs:

Numbered Paragraph 1. A method for operating a refrigerant circuit (1), in particular for an air conditioning system (100), in which a refrigerant circulates, wherein heat is transferred to the refrigerant from a first heat source (3) in a first heat pump mode (5), and from a second heat source (4) that is different from the first heat source (3) in a second heat pump mode (6), characterized in that heat is transferred to the refrigerant from the first heat source (3) and the second heat source (4) in a combined heat pump mode (7).

Numbered Paragraph 2. The method according to Numbered Paragraph 1, characterized in that in a first heating mode, the refrigerant circuit (1) is operated in the first heat pump mode (5), if the temperature of the first heat source (3) is higher than or equal to a first heat source upper temperature, the refrigerant circuit (1) is operated in the second heat pump mode (6) if the temperature of the first heat source (3) is lower than a first heat source lower temperature, which is lower than the first heat source upper temperature, the refrigerant circuit (1) is operated in the combined heat pump mode (7) if the temperature of the first heat source (3) is between the first heat source upper temperature and the first heat source lower temperature.

Numbered Paragraph 3. The method according to Numbered Paragraph 2, characterized in that the first heat source upper temperature is between −1° C. and 1° C., in particular 0° C.

Numbered Paragraph 4. The method according to Numbered Paragraph 2 or 3, characterized in that the first heat source lower temperature is between −15° C. and −5° C., in particular −10° C.

Numbered Paragraph 5. The method according to Numbered Paragraphs 1 to 4, characterized in that in a second heating mode the refrigerant circuit (1) is operated in a first heat pump mode (5) if the difference between the temperatures of the first heat source (3) and second heat source (4) is greater than an upper temperature difference, the refrigerant circuit (1) is operated in the second heat pump mode (6) if the difference between the temperatures of the first heat source (3) and second heat source (4) is smaller than a lower temperature difference, which is lower than the upper temperature difference, the refrigerant circuit (1) is operated in the combined heat pump mode if the difference between the temperatures of the first heat source (3) and second heat source (4) is between the lower temperature difference and upper temperature difference.

Numbered Paragraph 6. The method according to Numbered Paragraph 5, characterized in that the lower temperature difference is 2 K to 10 K below the upper temperature difference.

Numbered Paragraph 7. The method according to Numbered Paragraph 6, characterized in that the lower temperature difference is 4 K to 6 K below the upper temperature difference.

Numbered Paragraph 8. The method according to any of the Numbered Paragraphs 4 to 7, characterized in that the upper temperature difference is between −0.5 K and 1.5 K, in particular 0 K.

Numbered Paragraph 9. The method according to any of the Numbered Paragraphs 1 to 8, characterized in that ambient air is used in the refrigerant circuit (1) as the first heat source.

Numbered Paragraph 10. The method according to any of the Numbered Paragraphs 1 to 9, characterized in that a coolant is used as the second heat source, which circulates through a coolant circuit (101) that is separate from the refrigerant circuit (1), wherein at least one element (202) that generates heat, in particular a drive element (203) for a vehicle (200), is integrated in the coolant circuit (101), which heats the coolant when in operation.

Numbered Paragraph 11. The method according to any of the Numbered Paragraphs 1 to 10, characterized in that the portion of the heat transferred to the refrigerant from the second heat source (4) is increased in relation to the heat transferred from the first heat source (3) when the temperature of the first heat source (3) decreases.

Numbered Paragraph 12. The method according to Numbered Paragraph 11, characterized in that the portion increases in stages.

Numbered Paragraph 13. The method according to any of the Numbered Paragraphs 1 to 12, characterized in that the refrigerant circuit (1) has a first heat exchanger (8) that absorbs heat from the first heat source (3) and a second heat exchanger (9) that absorbs heat from the second heat source (4), wherein the refrigerant flows through the first heat exchanger (8) but not through the second heat exchanger (9) in the first heat pump mode (5), the refrigerant flows through the second heat exchanger (9) but not through the first heat exchanger (8) in the second heat pump mode, and the refrigerant flows through the first heat exchanger (8) and the second heat exchanger (9) in the combined heat pump mode.

Numbered Paragraph 14. An air conditioning system (100) for controlling the temperature of conditioned air (102), with a refrigerant circuit (1) in which a refrigerant circulates, and a coolant circuit (101) in which a coolant circulates separately from the refrigerant, with a first heat exchanger (8) through which the refrigerant and ambient air flow separately, with a second heat exchanger (9) through which the refrigerant and the coolant flow separately, with a third heat exchanger (10) through which the refrigerant and the conditioned air (102) flow separately, with a valve assembly (11) which can be set to at least three settings, such that the valve assembly (11), allows the refrigerant to flow through the first heat exchanger (8) and third heat exchanger (10) but not through the second heat exchanger (9) in the first setting, allows the refrigerant to flow through the second heat exchanger (9) and third heat exchanger (10) but not through the first heat exchanger (8) in the second setting, allows the refrigerant to flow through the first heat exchanger (8), second heat exchanger (9), and third heat exchanger (10) in the third setting, with a control unit (13) that is designed to operate the refrigerant circuit (1) according to the method set forth in the Numbered Paragraphs 1 to 13, wherein ambient air forms the first heat source (3) and coolant forms the second heat source (4).

The invention claimed is:

1. A method for operating a refrigerant circuit for an air conditioning system, the method comprising:

circulating a fluid refrigerant through a fluid circuit, providing a first heat source in a first heat pump mode, providing a second heat source that is different from the first heat source in a second heat pump mode, providing a first heat exchanger, providing a second heat exchanger, providing a third heat exchanger, providing a valve assembly configurable to at least three settings, wherein a first setting of the at least three settings comprises valving the refrigerant to flow through the first heat exchanger and third heat exchanger but not through the second heat exchanger in the first setting, wherein a second setting of the at least three settings comprises valving the refrigerant to flow through the second heat exchanger and third heat exchanger but not through the first heat exchanger in the second setting, and wherein a third setting of the at least three settings comprises valving the refrigerant to flow through the first heat exchanger, second heat exchanger, and third heat exchanger in the third setting, transferring heat to the fluid refrigerant in the fluid circuit from the first heat source and the second heat source via valving the refrigerant in accordance with at least one of the first setting, the second setting, or the third setting.

2. The method according to claim 1, wherein in a first heating mode, the refrigerant circuit is operated in the first heat pump mode, if the temperature of the first heat source is higher than or equal to a first heat source upper temperature, the refrigerant circuit is operated in the second heat pump mode if the temperature of the first heat source is lower than a first heat source lower temperature, which is lower than the first heat source upper temperature, and the refrigerant circuit is operated in the combined heat pump mode if the temperature of the first heat source is between the first heat source upper temperature and the first heat source lower temperature.

3. The method according to claim 2, wherein the first heat source upper temperature is between −1° C. and 1° C.

4. The method according to claim 3, wherein the first heat source upper temperature is 0° C.

5. The method according to claim 2, wherein the first heat source lower temperature is between −15° C. and −5° C.

6. The method according to claim 5, wherein the upper temperature difference is between −0.5 K and 1.5 K.

7. The method according to claim 6, wherein the upper temperature difference is 0 K.

8. The method according to claim 5, wherein the heat source lower temperature is −10° C.

9. The method according to claim 1, wherein in a second heating mode the refrigerant circuit is operated in a first heat pump mode if the difference between the temperatures of the first heat source and second heat source is greater than an upper temperature difference, the refrigerant circuit is operated in the second heat pump mode if the difference between the temperatures of the first heat source and second heat source is smaller than a lower temperature difference, which is lower than the upper temperature difference, and the refrigerant circuit is operated in the combined heat pump mode if the difference between the temperatures of the first heat source and second heat source is between the lower temperature difference and upper temperature difference.

10. The method according to claim 9 wherein the lower temperature difference is within a range of 2 K to 10 K below the upper temperature difference.

11. The method according to claim 10, wherein the lower temperature difference is within a range of 4 K to 6 K below the upper temperature difference.

12. The method according to claim 1, wherein ambient air is used in the refrigerant circuit as the first heat source.

13. The method according to claim 1, wherein a coolant is used as the second heat source, which circulates through a coolant circuit that is separate from the refrigerant circuit, wherein at least one element that generates heat, in particular a drive element for a vehicle, is integrated in the coolant circuit, which heats the coolant when in operation.

14. The method according to claim 1, wherein the portion of the heat transferred to the refrigerant from the second heat source is increased in relation to the heat transferred from the first heat source when the temperature of the first heat source decreases.

15. The method according to claim 14, wherein the portion increases in stages.

16. The method according to claim 1, wherein the refrigerant circuit has a first heat exchanger that absorbs heat from the first heat source and a second heat exchanger that absorbs heat from the second heat source, wherein the refrigerant flows through the first heat exchanger but not through the second heat exchanger in the first heat pump mode, the refrigerant flows through the second heat exchanger but not through the first heat exchanger in the second heat pump mode, and the refrigerant flows through the first heat exchanger and the second heat exchanger in the combined heat pump mode.

17. An air conditioning system for controlling a temperature of conditioned air, comprising:

a refrigerant circuit in which a refrigerant circulates, and a coolant circuit in which a coolant circulates separately from the refrigerant, a first heat exchanger through which the refrigerant and ambient air flow separately, a second heat exchanger through which the refrigerant and the coolant flow separately, a third heat exchanger through which the refrigerant and the conditioned air flow separately, a valve assembly which can be set to at least three settings, such that the valve assembly, allows the refrigerant to flow through the first heat exchanger and third heat exchanger but not through the second heat exchanger in the first setting, allows the refrigerant to flow through the second heat exchanger and third heat exchanger but not through the first heat exchanger in the second setting, and allows the refrigerant to flow through the first heat exchanger, second heat exchanger, and third heat exchanger in the third setting, a control unit that is designed to operate the refrigerant circuit according to the method set forth in claim 1, wherein ambient air forms the first heat source and coolant forms the second heat source.

* * * * *